US008736416B2

(12) United States Patent
Takeda

(10) Patent No.: US 8,736,416 B2
(45) Date of Patent: May 27, 2014

(54) THERMAL PROTECTOR

(75) Inventor: Hideaki Takeda, Saitama (JP)

(73) Assignee: Uchiya Thermostat Co., Ltd. (JP)

( * ) Notice: Subject to any disclaimer, the term of this patent is extended or adjusted under 35 U.S.C. 154(b) by 0 days.

(21) Appl. No.: 13/619,458

(22) Filed: Sep. 14, 2012

(65) Prior Publication Data

US 2013/0076480 A1 Mar. 28, 2013

Related U.S. Application Data

(62) Division of application No. 12/863,128, filed as application No. PCT/JP2008/002795 on Oct. 3, 2008, now Pat. No. 8,421,580.

(30) Foreign Application Priority Data

Jan. 28, 2008 (JP) ..... 2008-016199

(51) Int. Cl.

| | |
|---|---|
| ***H01H 37/46*** | (2006.01) |
| ***H01H 37/04*** | (2006.01) |
| ***H01H 37/52*** | (2006.01) |
| ***H01H 37/54*** | (2006.01) |
| ***H01H 37/32*** | (2006.01) |

(52) U.S. Cl.

CPC ..... *H01H 37/46* (2013.01); *H01H 37/043* (2013.01); *H01H 37/5418* (2013.01); *H01H 37/32* (2013.01)

USPC ..... 337/377; 337/380; 337/398

(58) Field of Classification Search

CPC . H01H 37/32; H01H 37/043; H01H 37/5418; H01H 37/46

See application file for complete search history.

(56) References Cited

U.S. PATENT DOCUMENTS 3,223,808 A * 12/1965 Wehl ..... 337/360
3,443,259 A * 5/1969 Wehl et al. ..... 337/89
3,840,834 A * 10/1974 Obenhaus et al. ..... 337/79

(Continued)

FOREIGN PATENT DOCUMENTS

DE 19636320 A1 3/1997
DE 19922633 A1 11/1999

(Continued)

OTHER PUBLICATIONS

"U.S. Appl. No. 12/863,128, *Ex Parte Quayle* Action mailed Jun. 20, 2012", 11 pgs.

(Continued)

*Primary Examiner* — Anatoly Vortman

(74) *Attorney, Agent, or Firm* — Schwegman, Lundberg & Woessner, P.A.

(57) ABSTRACT

A self-hold type thermal protector according to the present invention includes a movable contact of a movable plate rises and separates from a fixed contact when a bimetal of the thermal protector inversely warps at a predetermined temperature, an electric current between the contacts, namely, an electric current between a movable contact side terminal and a fixed contact side terminal is disrupted, and the disrupted current flows into the polymer PTC element, which is then made to produce heat and is thermally expanded to increase a resistance value. A second terminal member on a side opposite to a first terminal member where the polymer PTC element is positioned and fixed forms a bowing part, and a gap h is formed between an upper inner wall of a housing and the upper surface of the second terminal member.

4 Claims, 6 Drawing Sheets

(56) References Cited

U.S. PATENT DOCUMENTS

| | | | | | |
|---|---|---|---|---|---|
| 4,262,273 | A * | 4/1981 | Grable | 337/67 |
| 4,319,126 | A * | 3/1982 | Lujic | 219/512 |
| 4,563,667 | A * | 1/1986 | Hofsass | 337/349 |
| 4,755,787 | A * | 7/1988 | Wehl | 337/372 |
| 4,862,132 | A * | 8/1989 | Hollweck | 337/102 |
| 4,878,038 | A * | 10/1989 | Tsai | 337/107 |
| 4,894,634 | A * | 1/1990 | Nezuka et al. | 337/343 |
| 5,103,202 | A * | 4/1992 | Lennon et al. | 337/100 |
| 5,233,325 | A * | 8/1993 | Takeda | 337/107 |
| 5,309,131 | A * | 5/1994 | Hofsass et al. | 337/102 |
| 5,367,279 | A * | 11/1994 | Sakai | 337/104 |
| 5,428,336 | A * | 6/1995 | Smith et al. | 337/365 |
| 5,607,610 | A * | 3/1997 | Furukawa | 219/505 |
| 5,621,376 | A * | 4/1997 | Takeda | 337/372 |
| 5,757,262 | A * | 5/1998 | Takeda | 337/380 |
| 5,804,798 | A * | 9/1998 | Takeda | 219/511 |
| 5,847,637 | A * | 12/1998 | Takeda et al. | 337/344 |
| 5,909,168 | A | 6/1999 | Miyasaka et al. | |
| 5,936,510 | A * | 8/1999 | Wehl et al. | 337/377 |
| 5,973,587 | A * | 10/1999 | Hofsass | 337/377 |
| 6,020,807 | A * | 2/2000 | Givler | 337/377 |
| 6,031,447 | A * | 2/2000 | Hofsass | 337/377 |
| 6,249,210 | B1 * | 6/2001 | Hofsass | 337/324 |
| 6,265,961 | B1 * | 7/2001 | Takeda | 337/333 |
| 6,300,858 | B1 * | 10/2001 | Kalapodis et al. | 337/140 |
| 6,300,860 | B1 * | 10/2001 | Hofsass | 337/377 |
| 6,346,796 | B1 * | 2/2002 | Takeda | 320/154 |
| 6,396,381 | B1 * | 5/2002 | Takeda | 337/377 |
| 6,414,285 | B1 * | 7/2002 | Takeda | 219/507 |
| 6,633,222 | B2 * | 10/2003 | Nagai et al. | 337/365 |
| 6,801,116 | B2 * | 10/2004 | Oh et al. | 337/112 |
| 6,995,647 | B2 * | 2/2006 | Stiekel | 337/112 |
| 7,330,097 | B2 * | 2/2008 | Takeda | 337/102 |
| 8,421,580 | B2 | 4/2013 | Takeda | |
| 2010/0308954 | A1 | 12/2010 | Takeda | |
| 2011/0043321 | A1 * | 2/2011 | Takeda | 337/362 |

FOREIGN PATENT DOCUMENTS

| | | | |
|---|---|---|---|
| DE | 10037161 | A1 | 2/2001 |
| EP | 507425 | A1 | 10/1992 |
| JP | 6-119859 | A | 4/1994 |
| JP | 2000-505594 | A | 5/2000 |
| JP | 2001-035330 | A | 2/2001 |
| JP | 2005-129471 | A | 5/2005 |
| JP | 2005-203277 | A | 7/2005 |
| JP | 2005-237124 | A | 9/2005 |
| WO | WO-97/29492 | A2 | 8/1997 |

OTHER PUBLICATIONS

"U.S. Appl. No. 12/863,128, Notice of Allowance mailed Dec. 14, 2012", 7 pgs.

"U.S. Appl. No. 12/863,128, Response filed May 7, 2012 to Restriction Requirement mailed Apr. 6, 2012", 7 pgs.

"U.S. Appl. No. 12/863,128, Response Filed Oct. 19, 2012 to *Ex Parte Quayle* Action mailed Jun. 20, 2012", 11 pgs.

"U.S. Appl. No. 12/863,128, Restriction Requirement mailed Apr. 6, 2012", 6 pgs.

"German Application Serial No. 112008003632.2, German Office Action dated Jun. 10, 2013", 4 pgs.

"International Application Serial No. PCT/JP2008/002795, International Preliminary Report on Patentability mailed Aug. 31, 2010", (w/ English Translation of Written Opinion), 4 pgs.

"International Application Serial No. PCT/JP2008/002795, International Search Report mailed Nov. 25, 2008", 4 pgs.

"International Application Serial No. PCT/JP2008/002795, Written Opinion mailed Nov. 25, 2008", 3 pgs.

"Japanese Application Serial No. 2009-551323, Office Action mailed Feb. 21, 2012", (w/ English Translation), 4 pgs.

* cited by examiner

THERMAL PROTECTOR

RELATED APPLICATIONS

This application is a divisional application of U.S. patent application Ser. No. 12/863,128, filed Jul. 15, 2010, now U.S. Pat. No. 8,421,580 which is a U.S. National Stage Filing filed under 35 U.S.C. 371 from International Application No. PCT/JP2008/002795, filed on Oct. 3, 2008, and published as WO 2009/095961 A1 on Aug. 6, 2009, which claimed priority under 35 U.S.C. 119 to Japanese Application No. 2008-016199, filed Jan. 28, 2008, which applications and publication are incorporated herein by reference in their entirety.

TECHNICAL FIELD

The present invention relates to a thermal protector for preventing a temperature of an electric product from rising too high, and more particularly, to a thermal protector in which a polymer PTC element is embedded in a safe state where a hot spot does not occur.

BACKGROUND ART

Conventionally, a self-hold type thermal protector including a ceramic PTC (Positive Temperature Coefficient) element connected in parallel with a contact circuit is used as a device for preventing a temperature of an electric product from rising too high.

Such thermal protectors are intended to mainly prevent a temperature of an electric product using a commercial power supply from rising too high, and some thermal protectors control a disruption of an electric current of a voltage as high as 100 to 200V.

However, in some thermal protectors, a ceramic PTC element is used as a device for preventing a temperature from rising too high even in an area using an electric current of a low voltage such as a battery pack.

If such a thermal protector intended to prevent a temperature from rising too high is used in a circuit having a voltage equal to or lower than a commercial power supply voltage, a polymer PTC element having a low resistance is available as an embedded PTC element.

The principle of disrupting an electric current of this polymer PTC element is that a conductive path via conductive particles dispersed in a polymer is disconnected by a volume expansion caused by a thermal expansion in the vicinity of the melting point of the polymer due to an increase in a temperature, leading to a rapid increase in an internal resistance, which significantly reduces an electric current.

In the meantime, a phenomenon wherein an electric current locally gathers a hot spot can be possibly caused if a volume expansion is hindered for any reason.

FIG. 5 is a cross-sectional view of a PTC conductive polymer device disclosed by Patent Document 1. The PTC conductive polymer device has a housing composed of a case 1, and an insulative member 11 for sealing an opening of the case 1. Moreover, a first metal member 2 and a second metal member 3 are held by the housing.

For the first metal member 2 and the second metal member 3, terminal elements 21 and 31 that respectively protrude outside from the housing are formed, and holding elements 22 and 32 that are bent in an inwardly convex shape are formed within the housing.

At close to the middle of the holding elements 22 and 32, upwardly convex parts 221 and 321 are respectively formed at nearly facing positions. A PTC element 43 having layered metal electrodes 41 and 42 on both surfaces is held between the upwardly convex parts 221 and 321.

In this PTC conductive polymer device, the electrodes 41 and 42 of the PTC element 43 are pushed into a narrow space by the upwardly convex parts 221 and 321. Therefore, it is possible for the above described hot spot to occur when the PTC element 43 produces heat.

Additionally, if a current disrupt circuit implemented with a bimetal is embedded in parallel with the holding elements 22 and 32 in order to convert the structure of the PTC conductive polymer device into a self-hold type, heat produced by the PTC element 43 cannot be effectively conducted to the bimetal in a structure in which the PTC element 43 is arranged between the holding elements 22 and 32. Therefore, the structure of the PTC conductive polymer device that is illustrated in FIG. 5 and disclosed by Patent Document 1 is not applicable to a self-hold type.

A self-hold type thermal protector adopting a ceramic PTC element is well known.

FIG. 6 is a perspective top view and aside sectional view of a structure of a self-hold type thermal protector adopting a conventional ceramic PTC element. The self-hold type thermal protector 50 has a housing composed of an insulative case 51-1 and an insulative seal member 51-2 for sealing an opening of the insulative case 51-1.

Within the housing, a movable plate 53 made of a metal plate having high thermal conductivity, a bimetal 54 attached to the movable plate 53, a movable contact 55 provided at a movable side end of the movable plate 53, a first conductive member 57 having a fixed contact 56 at a position facing the movable contact 55, a ceramic PTC element 58 arranged in contact with a lower surface of a fixed side end of the movable plate 53, and a second conductive member 59 arranged in contact with an upper surface of the fixed side end of the movable plate 53 are provided.

The second conductive member 59, the fixed side end of the movable plate 53, and the ceramic PTC element 58 are aligned by a support column 52, and the second conductive member 59 and the ceramic PTC element 58 that are arranged to interpose the fixed side end of the movable plate 53 therebetween are swaged by the top and the bottom ends of the support column 52, whereby the second conductive member 59, the fixed side end of the movable plate 53, and the ceramic PTC element 58 are pressed and fixed.

Additionally, for the first conductive member 57 and the second conductive member 59, a first terminal part 57-1 and a second terminal part 59-1 that respectively protrude outside from the housing in order to connect to an external circuit are formed.

In this self-hold type thermal protector 50, the movable side end of the movable plate 53 is moved upward by the bimetal 54, which is a bimetallic element, and inversely warps with an increase in an ambient temperature. As a result, the movable contact 55 moves upward from a closed position illustrated in FIG. 6 to open a contact circuit with the fixed contact 56, whereby an electric current between the first terminal part 57-1 and the second terminal part 59-1 is disrupted.

On upper and lower surfaces of the ceramic PTC element 58, thin-layer electrodes are respectively formed. The electric current disrupted between the first terminal part 57-1 and the second terminal part 59-1 flows into the ceramic PTC element 58 via the electrodes positioned on the upper and the lower surfaces.

As a result, the ceramic PTC element 58 produces heat, and the inverted warp state of the bimetal 54, namely, the current disrupt state of the self-hold type thermal protector 50, is maintained, and at the same time, the electric current flowing into the ceramic PTC element 58 is significantly reduced by an increase in an electric resistance value with heat production.

In the meantime, in the conventional self-hold type thermal protector 50 illustrated in FIG. 6, the sides of the electrodes positioned on the upper and the lower surfaces of the ceramic PTC element 58 are respectively pressed against the fixed side end of the movable plate 53 and the first conductive member 57 by being swaged by the support column 52 in order to effectively conduct the heat produced by the ceramic PTC element 58 to the bimetal 54.

For the ceramic PTC element 58, its volume expansion by heat production is small enough to be ignorable. Accordingly, there is no possibility that the hot spot described in the PTC conductive polymer device will not occur.

However, if the resistive element (ceramic PTC element 58) is arranged in the conventional self-hold type thermal protector 50 as illustrated in FIG. 6, the sides of the electrodes positioned on the upper and the lower surfaces are respectively pressed against the fixed side end of the movable plate 53 and the first conductive member 57 as described above, and the upper and the lower surfaces, which have the widest areas of the plate, are strongly pushed upward and downward.

Accordingly, if the polymer PTC element is used as a resistive element having a low resistance in a structure similar to that of FIG. 6, the polymer PTC element is strongly pushed upward and downward as described above. Therefore, the degree of freedom of the volume expansion caused by the thermal expansion of the polymer PTC element at the time of heat production is hindered, leading to an inevitable occurrence of the above described hot spot.

Patent Document 1: Japanese National Publication of International Patent Application No. 2000-505594

DISCLOSURE OF INVENTION

An object of the present invention is to provide, in light of the above described conventional circumstances, a thermal protector including a polymer PTC element in a safe state where a hot spot does not occur even if a volume is expanded by a thermal expansion at the time of heat production.

A thermal protector according to a first aspect of the present invention is a thermal protector performing self-holding with heat produced by an embedded resistive element after an electric current is disrupted when an ambient temperature rises to a predetermined temperature or higher. The thermal protector comprises: a bimetallic element inversely warping at a predetermined temperature; a conductive movable plate having a fixed end part connected to one of two external circuit, and a movable end part where a movable contact is provided on a side opposite to the fixed end part, the movable end part being driven to move the movable contact from a closed side to an open side with an inverse warp operation of the bimetallic element at the predetermined temperature; a conductive fixture plate having a fixed contact at a position facing the movable contact, and a connection part connected to the other of the external circuits; and the resistive element where one of the electrodes on both surfaces of an internal resistor is connected and fixed to the fixed end part of the movable plate via a first terminal member, and the other electrode is connected to the fixture plate via a second terminal member in a state where the second terminal member can fluctuate.

In this thermal protector for example, the second terminal member has a bowing part, and is connected to the fixture plate so as to be able to fluctuate with the fixture plate via the bowing part.

Additionally, the resistive element is, for example, formed in the shape of a plate, and has a hole that penetrates into the internal resistor and the electrodes on both the surfaces in a thickness direction of the plate, the first terminal member has a hole smaller than the hole in a portion that overlaps with the hole, and is connected and fixed to the fixed end part of the movable plate by swaging a periphery of the hole smaller than the hole with a member that forms a swage part within the hole, and the second terminal member has a hole at least equal to or larger than the hole in a portion that overlaps with the hole, and is arranged by forming a gap in which the second terminal member can fluctuate by a thickness increased by a thermal expansion of the internal resistor of the resistive element and which is formed between an inner wall of the main body housing of the thermal protector and the second terminal member.

A thermal protector according to a second invention is a thermal protector performing self-holding with heat produced by an embedded resistive element after an electric current is disrupted when an ambient temperature rises to a predetermined temperature or higher. The thermal protector comprises: a bimetallic element inversely warping at a predetermined temperature; a conductive movable plate having a fixed end part connected to one of two external circuit, and a movable end part where a movable contact is provided on a side opposite to the fixed end part, the movable end part being driven to move the movable contact from a closed side to an open side with an inverse warp operation of the bimetallic element at the predetermined temperature; a first terminal member in which a fixed contact is provided at a position facing the movable contact, and which has a connection part connected to the other of the external circuits, the first terminal member being arranged so as to be able to fluctuate with a main body housing of thermal protector; and the resistive element where one of the electrodes on both surfaces of an internal resistor is connected and fixed to the fixed end part of the movable plate via a second terminal member, and the other electrode is connected to the first terminal member.

In this thermal protector for example, the resistive element is formed in the shape of a plate, a hole that penetrates into the internal resistor and the electrodes on both the surfaces is provided in a thickness direction of the plate, a hole that is at least equal to or larger than the hole is formed in a portion that overlaps with the hole in the first terminal member, which is arranged with a gap in which the first terminal member can fluctuate within the range of a thickness that has been increased by a thermal expansion of the internal resistor of the resistive element and which is formed between an inner wall of the main body housing of the thermal protector and the first terminal member, and a hole that is smaller than the hole is provided in a portion that overlaps with the hole in the second terminal member, which is connected and fixed to the fixed end part of the movable plate by swaging a periphery of the hole that is smaller than the hole with a member that forms a swage part within the hole.

The thermal protectors according to the first and the second inventions further comprise for example an insulative member that is provided at a position further inward than an insulative filling material for sealing an opening of the main body housing of the thermal protector and further outward than the resistive element, and that prevents the insulative filling material from intruding deeper.

Furthermore, a thermal protector according to a third invention is a thermal protector performing self-holding with heat produced by an embedded resistive element after an electric current is disrupted when an ambient temperature rises to a predetermined temperature or higher. The thermal protector comprises: a movable side terminal which has a terminal part connected to one of two external circuits, and in which a support column hole and a swage part are formed at an end part on a side opposite to the end part; a bimetallic element having an end part connected to the one of two external circuits, a movable side terminal where a first support column hole and a swage part are formed at an end part on a side opposite to the end part, an inverse warp operation part that inversely warps at a predetermined temperature, and a connection part which is adjoined to the inverse warp operation part and in which a second support column hole having a same shape as the first support column hole is formed; a movable plate having an end part where a hook part engaging with one end of the bimetallic element is formed, a movable contact formed on a surface side opposite to a direction where a hook of the hook part is formed at the end part, and a connection part where a second support column hole having a same shape as the first support column hole is provided at an end part on a side opposite to the end part; a resistive element which has an internal resistor shaped like a plate, and surface electrodes respectively formed on both surfaces of the internal resistor, and in which a third support column hole that is larger than the first support column hole is formed through the internal resistor and the surface electrodes on both the surfaces in a thickness direction of the plate, one of the surface electrodes being connected to the connection part of the movable plate via a first terminal member, and the other electrode being connected to a second terminal member; a fixed side terminal which is connected to the second terminal member and has a terminal part connected to the other of the external circuits, and in which a fourth support column hole having a same size as the first support column hole and a swage part are formed; a support column that penetrates into a support column hole having a same size as support column holes of members such as the movable side terminal, the bimetallic element, the movable plate, the resistive element and the fixed side terminal, and a support column hole that is larger than the first support column hole, and that holds the members by swaging the swage parts of the movable side terminal and the fixed side terminal; and an insulative rigid member that is formed to be higher than a thickness of the internal resistor of the resistive element and the surface electrodes respectively formed on both the surfaces of the internal resistor, and is interposed between the support column and an inner wall of a support column hole that is larger than the support column hole formed in the resistive element.

The thermal protectors according to the first to the third inventions are characterized in that the resistive element effectively functions also as a polymer PTC (Positive Temperature Coefficient) element.

As described above, according to the present invention, a terminal member connected to one of the electrodes on both surfaces of a plate-shaped PTC element is fixed to a fixed side of a movable plate, and a terminal member connected to the other electrode is configured to be able to fluctuate within the range of a thickness that has been increased by a thermal expansion of the PTC element. As a result, a self-hold type thermal protector where the PTC element effectively functions as a polymer PTC element as well can be provided.

EXPLANATION OF CODES

Figure 1A:
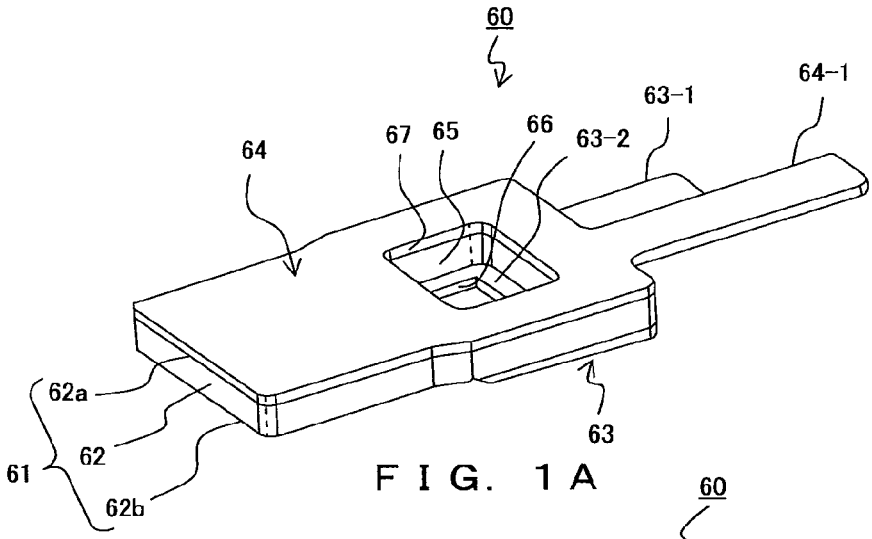
FIG. 1A is a perspective view illustrating a resistive element module used in a thermal protector according to a first embodiment.

50 conventional self-hold type thermal protector
51-1 insulative case
51-2 insulative seal member
52 support column
53 movable plate
54 bimetal
55 movable contact
56 fixed contact
57 first conductive member
58 ceramic PTC element
59 second conductive member
60 resistive element module
61 resistive element (polymer PTC element)
62 internal resistor
62*a*, 62*b* electrode
63 first terminal member
63-1 movable contact side external connection terminal part
63-2 periphery of smaller hole
64 second terminal member
64-1 fixed contact side fluctuation terminal part
64-1*a* corner
65 hole
66 smaller hole
67 equal or larger hole
70 thermal protector
71 case
72 insulative filling material
73 housing
74 bimetallic element (bimetal)
75 movable plate
76 movable contact side terminal
77 movable contact
78 fixed contact
79 fixture plate
79-1 fixed contact side terminal
81 support column
82 seal film
85 resistive element module
86 polymer PTC element
87 fixed contact side terminal member
87-1 fixed contact side external terminal

88 movable contact side terminal member
88-1 movable contact side external terminal
88-2 periphery of smaller hole
89 internal resistor
89*a*, 89*b* electrode
91 fixed contact
92 housing
93 hole
94 smaller diameter
95 swage member
96 movable plate
97 movable side terminal
98 hole
100 thermal protector
101 bimetal
102 case
103 insulative filling material
104 movable contact
105 hook
107 bimetal
108 movable plate
109 spacer
110 resistive element module
111 fixed contact side terminal
112 support column
112-1 flange part
113 lower layer part
114 upper layer part
115 slightly smaller hole
116 slightly larger hole
117 terminal connection part
118 hole
119 terminal connection part
121 hole
122 movable contact
123 hook part
124 hole
125 internal resistor
126 movable contact side connection terminal
127 fixed contact side connection terminal
128 hole
129 support part
131 contact part
132 level-difference hole
134 housing
135 thermal protector

BEST MODE OF CARRYING OUT THE INVENTION

Figure 1B:
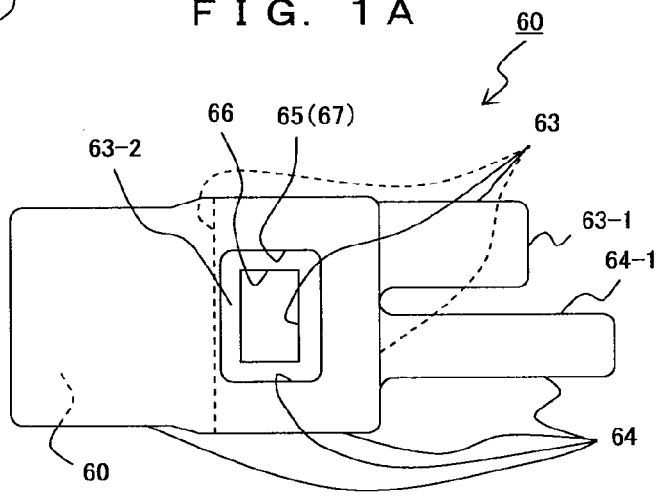
FIG. 1B is a top view of FIG. 1A.
Figure 1C:
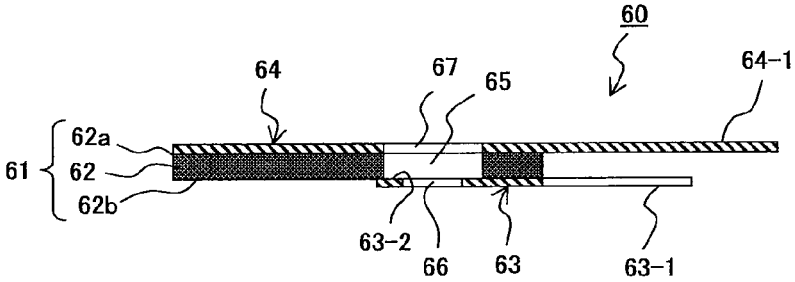
FIG. 1C is a side sectional view of FIG. 1A.

FIG. 1A is a perspective view illustrating a resistive element module used in a thermal protector according to a first embodiment. FIG. 1B is a top view of the resistive element module. FIG. 1C is a side sectional view of the resistive element module. The resistive element module 60 illustrated in FIGS. 1A, 1B and 1C is composed of a polymer PTC element 61, a first terminal member 63, and a second terminal member 64.

In this embodiment, the polymer PTC element 61 as a resistive element is composed of an internal resistor 62, and thin-layer electrodes 62*a* and 62*b* are respectively pasted onto upper and lower surfaces of the internal resistor 62. The entire polymer PTC element 61 is formed in the shape of a plate.

Onto one electrode 62*b* of the electrodes positioned on the upper and the lower surfaces of the internal resistor 62, a first terminal member 63 is pasted. For the first terminal member 63, a movable contact side external connection terminal part 63-1 that outwardly protrudes from the surface pasted onto the electrode 62*b* of the internal resistor 62 is formed.

Additionally, onto the other electrode 62*a* of the internal resistor 62, the second terminal member 64 is pasted. For the second terminal member 64, a fixed contact side fluctuation terminal part 64-1 that outwardly protrudes from the surface pasted onto the electrode 62*a* of the internal resistor 62 is formed.

In the above described plate-shaped polymer PTC element 61, a hole 65 that penetrates into the internal resistor 62 and the electrodes 62*a* and 62*b* pasted onto both the surfaces is formed in the thickness direction of the plate. This hole 65 is shaped roughly like a rectangle. However, the hole 65 may be shaped like, for example, a circle or a polygon having three or more sides. The shape of the hole 65 is not limited.

In FIGS. 1A, 1B, and 1C, for the first terminal member 63, a hole 66 that is smaller than the hole 65 is formed in a portion that overlaps with the hole 65. The first terminal member 63 is connected and fixed to a fixed end part of a movable plate to be described later by swaging a periphery 63-2 of the hole 66 that is smaller than the hole 65 with a swage member.

Namely, the entire resistive element module is configured to be supported by the housing via the fixed end part of the movable plate when being embedded, as one element of a thermal protector to be described later, within the housing of the thermal protector.

Additionally, in the second terminal member 64, a hole 67 that is at least equal to or larger than the hole 65 is formed in a portion that overlaps with the hole 65. Moreover, when the resistive element module is embedded in the housing, the fixed contact side fluctuation terminal part 64-1 is bent to nearly a right angle at some midpoint, the bent corner is shaped like an "R", and a bowing part is formed on the side of the polymer PTC element 61 further inward than the bent corner.

Figure 2A:
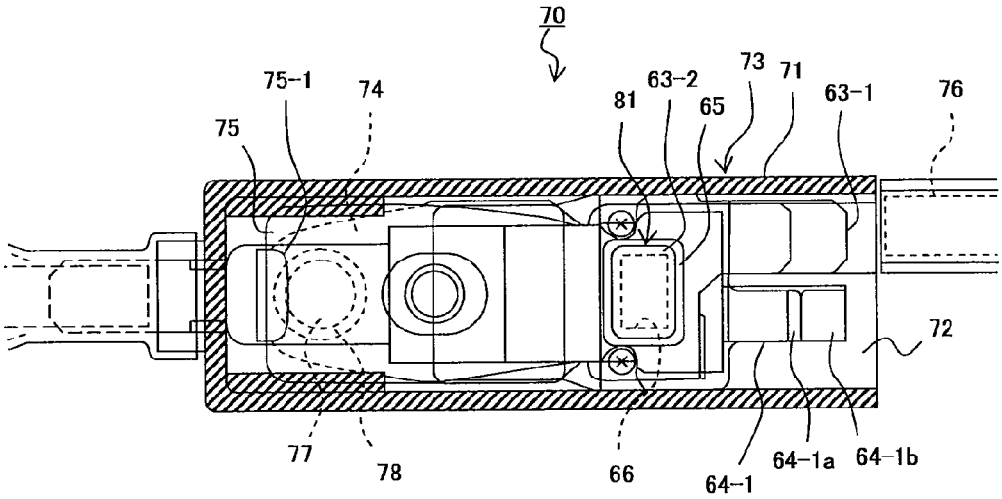
FIG. 2A is a perspective top view illustrating a thermal protector completed by embedding the resistive element module within a housing of the thermal protector according to the first embodiment.
Figure 2B:
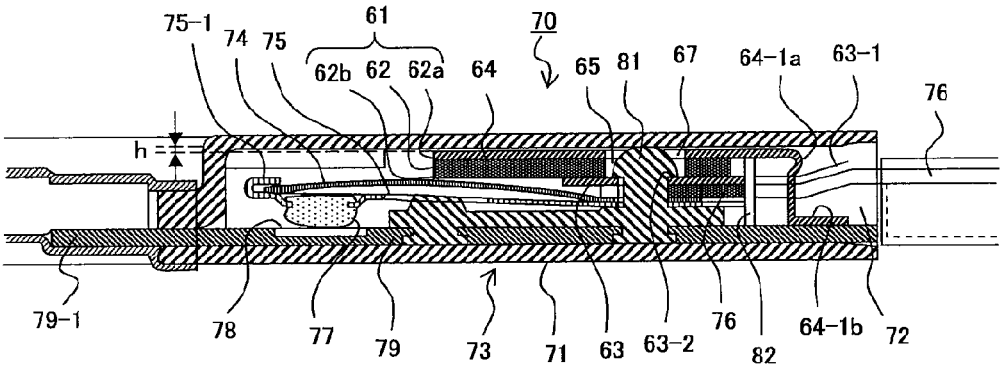
FIG. 2B is a side sectional view of FIG. 2A.

FIG. 2A is a perspective top view illustrating a state where the thermal protector according to this embodiment is completed by embedding the resistive element module, composed of the polymer PTC element 61, the first terminal member 63, and the second terminal member 64, into the housing of the thermal protector. FIG. 2B is a side sectional view of the thermal protector. In FIGS. 2A and 2B, the same components as those illustrated in FIGS. 1A, 1B and 1C are denoted with the same reference numerals as FIGS. 1A, 1B and 1C.

The thermal protector illustrated in FIGS. 2A and 2B is a thermal protector that performs self-holding with heat produced by the embedded resistive element (polymer PTC element 61) after an electric current is disrupted when an ambient temperature rises to a predetermined temperature or higher.

The thermal protector 70 illustrated in FIGS. 2A and 2B has a housing 73 configured with a box-shaped case 71, and an insulative filling material 72 for sealing an opening (the right end in these figures) of the case 71.

Within the housing 73, a bimetal 74 as a bimetallic element that inversely warps at a predetermined temperature and a conductive movable plate 75 that operates with the inverse warp operation of the bimetal 74 are included.

The movable plate 75 has a fixed end part (the left end part in these figures) connected to a movable contact side terminal 76 that is connected to one of two external circuits, and a movable end part on a side opposite to the fixed end part. At the movable end part, a movable contact 77 is provided. The movable end part of the movable plate 75 is driven to move the movable contact 77 from a closed side (the position illustrated in FIG. 2B) to an open side (an upwardly separated position) with the inverse warp operation of the bimetal 74 at the predetermined temperature.

At a position facing the movable contact 77, a fixed contact 78 is provided. The fixed contact 78 is securely fixed to a conductive fixture plate 79 having a fixed contact side terminal 79-1 connected to the other of the two external circuits.

In a connection part (the left end side of these figures) connected to the movable plate 75 of the movable contact side terminal 76, the fixed end part of the movable plate 75, which forms the connection part, and the fixture plate 79, a hole having almost the same size as the hole 66 is formed at a position corresponding to the smaller hole 66 of the first terminal member 63 of the resistive element module illustrated in FIG. 1.

An insulative support column 81 is formed through these holes from the bottom to the top of the housing 73. The bottom part of the support column 81 engages with the fixture plate 79 at a flange part. The top part of the support column 81 also serves as a swage member that configures a swage part within the large hole 65 of the polymer PTC element 61.

A periphery 63-2 of the smaller hole 66 of the first terminal member 63 is swaged by the top part of the support column 81. As a result, the first terminal member 63, the movable contact side terminal 76, the fixed end part of the movable plate 75, and the fixture plate 79 are aligned, pressed against one another, and fixed within the housing 73 by the column support 81. In consequence, the position of the polymer PTC element 61 is also fixed within the housing 73, via the first terminal member 63.

However, the fixed contact side fluctuation terminal part 64-1 of the polymer PTC element 61 is bent downward at nearly a right angle at some midpoint, and further bent below in a horizontal direction. At a corner 64-1*a* of the second terminal member 64, which is bent downward at a right angle, an "R" shape formed. Moreover, the end part 64-1*b* bent in the horizontal direction is securely connected to the fixture plate 79.

As a result, the second terminal member 64 forms a bowing part on the side of the polymer PTC element 61 further inward than the corner 64-1*a*, and can fluctuate with a volume expansion caused by the thermal expansion of the polymer PTC element 61.

The entire thermal protector is arranged so that a gap h is formed between the second terminal member 64 forming the bowing part and an upper inner wall of the housing 73. The gap h is set as a gap where the bowing part of the second terminal member 64 can fluctuate within the range of a thickness that has been increased by the thermal expansion of the internal resistor 62 of the polymer PTC element 61.

In the meantime, one end part (the right end part in FIG. 2B) of the bimetal 74 is interposed and fixed between the movable contact side terminal 76 and the fixed end part of the movable plate 75, and the other end (the left end part of FIG. 2B) that is a free end of the inverse warp operation engages with a hook 75-1 formed at the free end that holds the movable contact 77 of the movable plate 75. Moreover, the polymer PTC element 61 is closely arranged above almost one half of the bimetal 74 on the fixed end side.

As a result, when the polymer PTC element 61 produces heat, the total heat 61 can be efficiently conducted to the bimetal 74 with thermal conduction to the fixed end part of the bimetal 74 via the first terminal member 63 and the movable contact side terminal 76, and with radiation and convection within the housing 73 for almost one half of the bimetal 74 on the side of the fixed end part.

When the above described members are embedded in the housing 73, the internal configuration is initially assembled outside the housing 73, the assembled internal configuration is inserted from the opening of the case 71 in the case 71, and a seal film 82 is formed at a suitable position in the vicinity of the opening on the side of the opening further outward than the polymer PTC element 61.

The seal film 82 may be formed after the internal configuration is inserted in the case 71 from the opening of the case 71 as described above. Alternatively, the seal film 82 may be formed in advance at a desired position when the internal configuration is assembled outside the housing 73.

After the internal configuration is inserted in the case 71 and fixed at a predetermined position as described above, the case 71 is filled with the insulative filling material 72 at the opening and is hardened. The insulative filling material 72 does not impede the functions of the polymer PTC element 61 and the other members because the insulative filling material 72 is hindered from intruding deeper into the case 71 by the seal film 82 arranged at the position on the opening side further outward than the polymer PTC element 61.

The thermal protector 70 is normally used in a state where the contact circuit between the fixed contact 78 and the movable contact 77 is closed, as illustrated in FIG. 2B. At this time, an electric current is diverted also to the polymer PTC element 61. However, most of the electric current flowing between the movable contact side terminal 76 and the fixed contact side terminal 79-1 flows into the contact circuit, and the quantity of the diverted current flowing into the polymer PTC element 61 is very small. Accordingly, the quantity of the diverted current is not large enough to make the polymer PTC element 61 produce heat.

Operations of the thermal protector 70 having the above described configuration according to the first embodiment are described below.

Initially, when an environmental temperature (ambient temperature) of the thermal protector 70 rises to a predetermined temperature or higher, the bimetal 74 inversely warps from the upwardly convex state of FIG. 2B to the upwardly concave state.

The free end that holds the movable contract 77 of the movable plate 75 rises with the inverse warp operation of the bimetal 74. As a result, the movable contact 77 is separated from the fixed contact 78, and the current circuit, illustrated in FIG. 2B, between the movable contact 77 and the fixed contact 78 is disrupted.

The total quantity of the current between the movable contact side terminal 76 and the fixed contact side terminal 79-1 when the contact circuit is disrupted flows into the polymer PTC element 61, which is therefore made to produce heat.

As described above, the heat produced by the polymer PTC element 61 is efficiently conducted to the bimetal 74 with direct thermal conduction and an indirect radiation and convection, as described above.

A temperature applied to the bimetal 74 by the amount of heat conducted from the polymer PTC element 61 to the bimetal 74 as described above is equal to or higher than the above described predetermined temperature. Therefore, the bimetal 74 is not restored to the normal state illustrated in FIG. 2B, and the current disrupt state of the contact circuit is maintained until the current between the movable contact side terminal 76 and the fixed contact side terminal 79-1 is forcibly disrupted from outside.

As a result, thermal protector 70 that performs self-holding with the heat produced by the embedded resistive element after an electric current is disrupted is implemented.

In the meantime, normally in a polymer PTC element, a volume expansion is caused by a thermal expansion as described above if heat is produced, and an electric current flowing inside is significantly reduced. Therefore, the size of the electric current after the contact circuit is disrupted is not significantly reduced.

Additionally, in the configuration of the thermal protector 70 according to this embodiment, the second terminal member 64 on the side opposite to the first terminal member 63 where the polymer PTC element 61 is positioned and fixed forms the bowing part, and the gap h is provided between the upper inner wall of the housing 73 and the second terminal member 64 in order to cope with the caused volume expansion.

This gap h is set as a gap where the bowing part of the second terminal member 64 can fluctuate within the range of a thickness that has been increased by a volume expansion caused by the thermal expansion of the internal resistor 62 of the polymer PTC element 61.

As a result, the degree of freedom of the volume expansion caused by the thermal expansion of the polymer PTC element 61 is not hindered by an external pressure, and the first terminal member and the second terminal member 64, pasted onto the polymer PTC element 61, are respectively connected to wide areas of the thin-layer electrodes 61*a* and 61*b* of the polymer PTC element 61, thereby eliminating the possibility of causing the problem of the polymer PTC element 61 causing a hot spot.

As described above, the thermal protector 70 according to this embodiment can implement the stable current disrupt function, and the self-hold function after an electric current is disrupted even though the polymer PTC element having an unstable element is used as a resistive element for the current disrupt function at the time of heat production.

A thermal protector according to a second embodiment is described next.

Figure 3A:
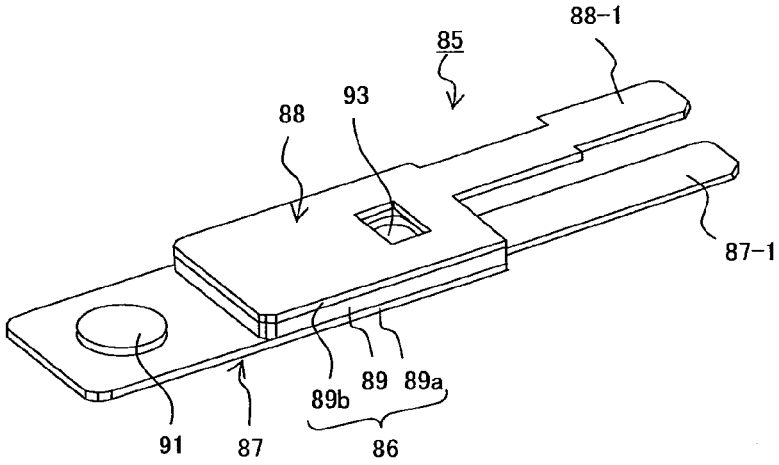
FIG. 3A is a perspective view illustrating a resistive element module used in a thermal protector according to a second embodiment.
Figure 3B:
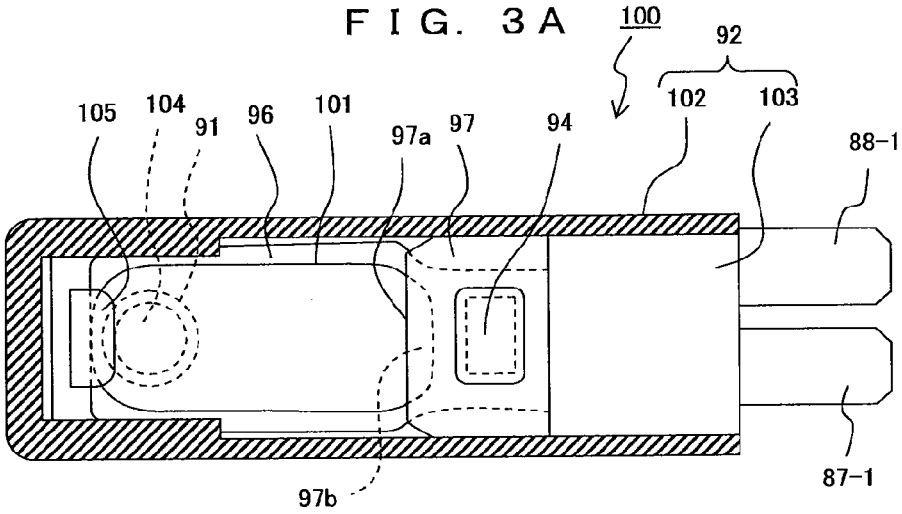
FIG. 3B is a top view of FIG. 3A.
Figure 3C:
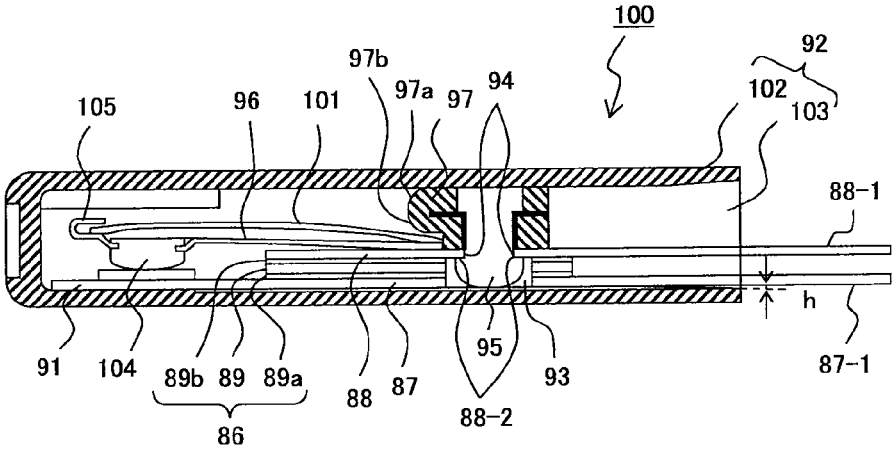
FIG. 3C is a side sectional view of FIG. 3A.

FIG. 3A is a perspective view illustrating a resistive element module used in the thermal protector according to the second embodiment. FIG. 3B is a top view of the resistive element module. FIG. 3C is a side sectional view of the resistive element module. The resistive element module 85 illustrated in FIGS. 3A, 3B and 3C is composed of a polymer PTC element 86, a fixed contact side terminal member 87, and a movable contact side terminal member 88.

In this embodiment, the polymer PTC element 86 as a resistive element is composed of an internal resistor 89 and thin-layer electrodes 89*a* and 89*b* respectively pasted onto upper and lower surfaces of the internal resistor 89. The entire polymer PTC element 86 is formed in the shape of a plate.

A middle part of the fixed contact side terminal 87 is pasted onto the entire surface of the electrode 89*a* of the internal resistor 89. On the fixed contact side terminal 87, a fixed contact 91 is formed at an end part that protrudes from the surface that has the electrode 89*a* of the internal resistor 89 pasted onto it in a longitudinal direction (horizontal direction in this figure). An end part on the opposite side protrudes from the housing 92 as illustrated in FIGS. 3B and 3C to form a thin fixed contact side external terminal 87-1.

In the meantime, one end part of the movable contact side terminal 88 is pasted onto the entire surface of the electrode 89*b* of the internal resistor 89. The other end part of the movable contact side terminal 88 protrudes to form a thin movable contact side external terminal 88-1 outside the housing 92 as illustrated in FIGS. 3B and 3C.

In the plate-shaped polymer PTC element 86, a hole 93 that penetrates into the internal resistor 89 and the electrodes 89*a* and 89*b* positioned on both the surfaces 89 is formed in the thickness direction. Also, the hole 93 in this embodiment is shaped roughly like a rectangle. However, the hole 93 may be shaped like, for example, a circle or a polygon having three sides or more. The shape of the hole 93 is not limited.

As illustrated in FIG. 3C, a hole 94 that is smaller than the hole 93 is formed in a portion that overlaps with the hole 93 in the movable contact side terminal 88, although this is not clearly illustrated in FIGS. 3A and 3B. The movable contact side terminal 88 is connected and fixed to a movable side terminal 97 along with the fixed end part of the movable plate 96 by swaging a periphery 88-2 of the hole 94 that is smaller than the hole 93 with a swage member 95 that also serves as a support column made of an insulative resin.

Namely, the entire resistive element module 85 is configured to be supported by the housing 92 via the fixed end part of the movable plate 96 and the movable side terminal 97 when the resistive element module 85 is embedded in the housing 92 of the thermal protector 100 as one element of the thermal protector 100, as illustrated in FIGS. 3B and 3C.

In the above described fixed contact side terminal 87, a hole 98 that is at least equal to or larger than the hole 93 is formed in a portion that overlaps with the hole 93. A swage part is formed by the swage member 95 within a space equal to or lower than a height of the overlapping holes 93 and 98. The functions of the resistive element module 85 are not limited except that the movable contact side terminal 88 is fixed to the housing 92 side with the periphery 88-2 of the smaller hole 94.

In this embodiment, a gap h is formed between the lower surface of the fixed contact side terminal 87 and a lower inner wall of the housing 92. The gap h is set as a gap where the fixed contact side terminal 87 can fluctuate within the range of a thickness that has been increased with the thermal expansion of the internal resistor 89 of the polymer PTC element 86.

As illustrated in FIGS. 3B and 3C, the above described resistive element module 85 is inserted in a case 102 of the housing 92 of the thermal protector 100 after being assembled with the movable plate 96, the bimetal 101, and the movable side terminal 97 by the swage member 95 that also serves as the support column, and the opening of the case 102 is sealed with an insulative filling material 103.

On the movable plate 96, a movable contact 104 is held at a position facing the fixed contact 91 in the vicinity of the opposite side, namely, the free end side of the fixed end part (the right end part in this figure), and a hook 105 that folds from the top to the right is formed at the end part.

One end part (the right end part in this figure) of the bimetal 101 is inserted in a gap formed between the bottom of a bent part 97*b* and the fixed end part of the movable plate 96, and the other end part (the left end part in this figure) is inserted in a void formed between the folding hook 105 of the movable plate 96 and the end part of the free end side, whereby the bimetal 101 is assembled to be able to inversely warp and is held by the movable plate 96.

Also in this embodiment, the seal film 82 illustrated in FIG. 2B may be formed at a suitable position on the opening side further outward than the polymer PTC element 86 in the vicinity of the opening when the members are embedded within the housing 92, although the seal film 82 is not illustrated in FIGS. 3B and 3C.

Also in this case, the seal film 82 may be formed after the internal configuration is inserted in the case 102. Alternatively, the seal film 82 may be naturally formed in advance at a desired position when the internal configuration is assembled outside the housing 102.

Additionally, in this embodiment, heat produced by the polymer PTC element 86 is directly conducted to the bimetal 101 via the movable contact side terminal 88 and the fixed end part of the movable plate 96 when the polymer PTC element 86 produces heat, and the polymer PTC element 86 is closely arranged below almost one half of the area of the lower surface on the fixed end side of the movable plate 95, whereby heat conducted from the movable plate 95 that is heated with the radiation of the polymer PTC element 86 is conducted to the bimetal 101, to which heat is conducted also with a convection within the housing 92.

As described above, also in this embodiment, the total heat produced by the polymer PTC element 86 can be efficiently conducted to the bimetal 101 when the polymer PTC element 86 produces heat.

Operations of the thermal protector 100 having the above described configuration according to the second embodiment are described below. Initially, when an environmental temperature (ambient temperature) of the thermal protector 100 rises to a predetermined temperature or higher, the bimetal 101 inversely warps from the upwardly convex state illustrated in FIG. 3C to the upwardly concave state.

The free end that holds the movable contact 104 of the movable plate 96 rises with the inverse warp operation of the bimetal 101. As a result, the movable contact 104 is separated from the fixed contact 91, and a current circuit, illustrated in FIG. 3C, between the movable contact 104 and the fixed contact 91 is disrupted.

The total quantity of an electric current between the fixed contact side external terminal 87-1 and the movable contact side external terminal 88-1 when the contact circuit is disrupted flows into the polymer PTC element 86, which is then made to produce heat. The heat produced by the polymer PTC element 86 is efficiently conducted to the bimetal 101 as described above.

A temperature increased by the amount of heat conducted from the polymer PTC element 86 to the bimetal 101 is equal to or higher than a predetermined temperature for the bimetal 101. Therefore, the bimetal 101 is not restored to the normal state illustrated in FIG. 3C, and the current disrupt state of the contact circuit is maintained until the current between the fixed contact side external terminal 87-1 and the movable contact side external terminal 88-1 is forcibly disrupted from outside.

As a result, also in this embodiment, the thermal protector 100 that performs self-holding with heat produced by the embedded resistive element after an electric current is disrupted is implemented.

Additionally, also in this embodiment, the gap h is formed between the fixed contact side terminal 87, where the polymer PTC element 86 is positioned and fixed, on the side opposite to the movable contact side terminal 88 and the lower inner wall of the case 102 of the housing 92. Therefore, the fixed contact side terminal 87 fluctuates to the side of the lower inner wall of the case 102 of the housing 92 within the range of a thickness that has been increased by a volume expansion caused by the thermal expansion with the heat produced by the polymer PTC element 86 when the volume is expanded.

As a result, the degree of freedom of the volume expansion caused by the thermal expansion of the polymer PTC element 86 is not hindered by an external pressure. Moreover, the fixed contact side terminal 87 and the movable contact side terminal 88, pasted onto the polymer PTC element 86, are respectively connected to wide areas of the thin-layer electrodes 89*a* and 89*b* of the polymer PTC element 86, thereby eliminating a possibility that the polymer PTC element 86 will cause a hot spot.

As described above, thermal protector 100 according to this embodiment can also implement the stable current disrupt function and the self-hold function after an electric current is disrupted, even though the polymer PTC element having an unstable element is used as a resistive element for the current disrupt function at the time of heat production.

In the meantime, in the above described first and second embodiments, the degree of freedom of the volume expansion caused by the thermal expansion of the internal resistor of the resistive element module 60 or 85 is not hindered by fixing the position of the resistive element module 60 or 85 with the terminal (the first terminal member 63 or the movable contact side terminal member 88) on the side of the movable contact of the resistive element module 60 or 85, and by arranging the terminal (the second terminal member 64 or the fixed contact side terminal member 87) on the fixed contact side to be able to fluctuate within the housing. However, a configuration that does not hinder the degree of freedom of the volume expansion caused by the thermal expansion of the internal resistor of the resistive element module is not limited to this one.

Another configuration that does not hinder the degree of freedom of the volume expansion caused by the thermal expansion of the internal resistor of the resistive element module is described below as a third embodiment.

Figure 4A:
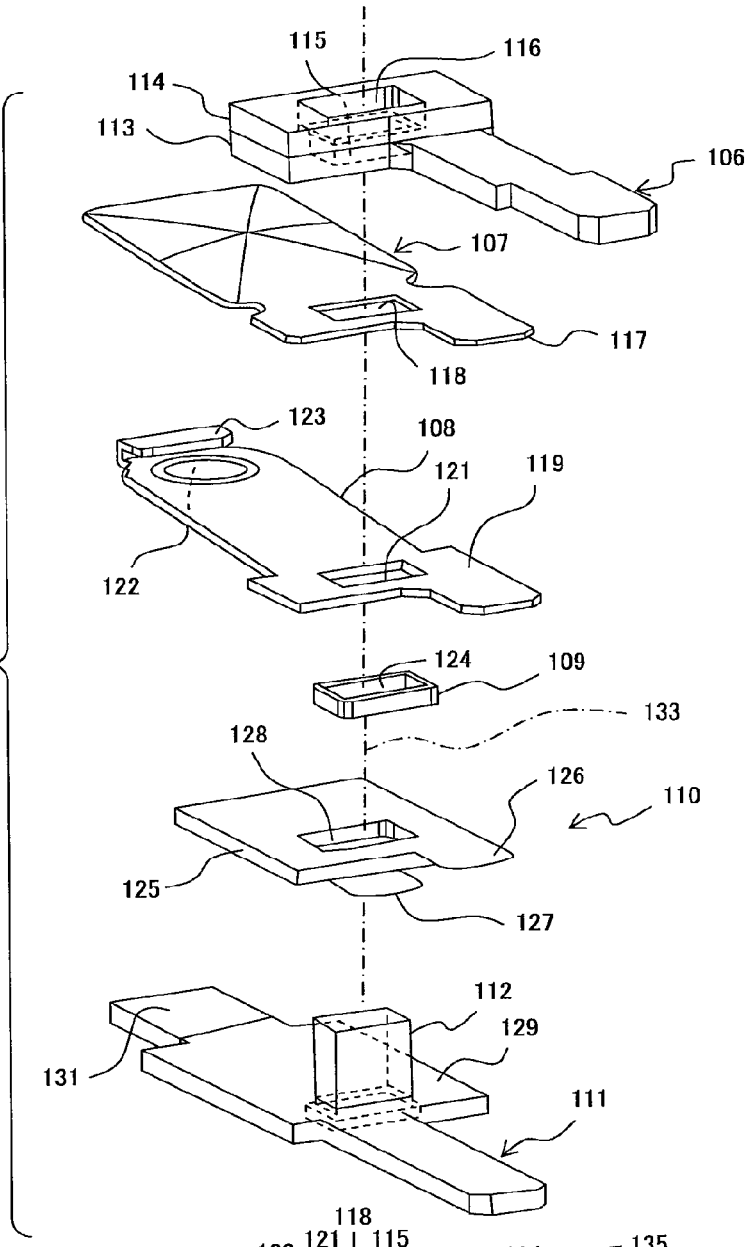
FIG. 4A is an exploded perspective view of an internal configuration of a thermal protector according to a third embodiment.
Figure 4B:
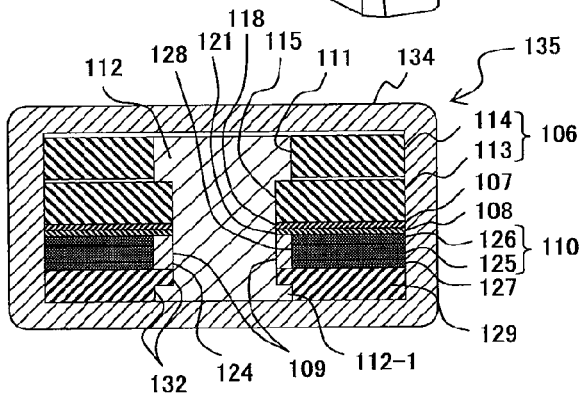
FIG. 4B is a cross-sectional view of the thermal protector assembled in FIG. 4A.
Figure 5:
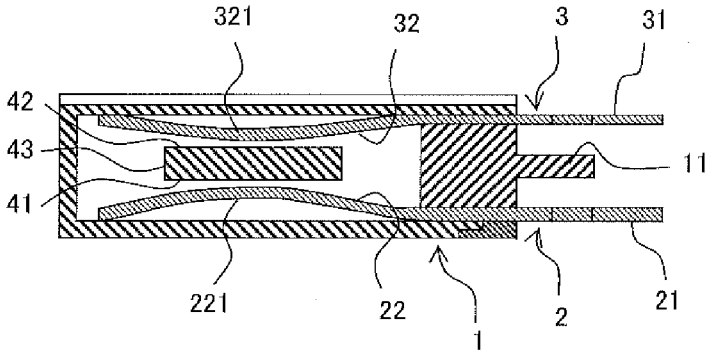
PRIOR ART F I G. 5
FIG. 5 is a cross-sectional view of a conventional PTC conductive polymer device.
Figure 6:
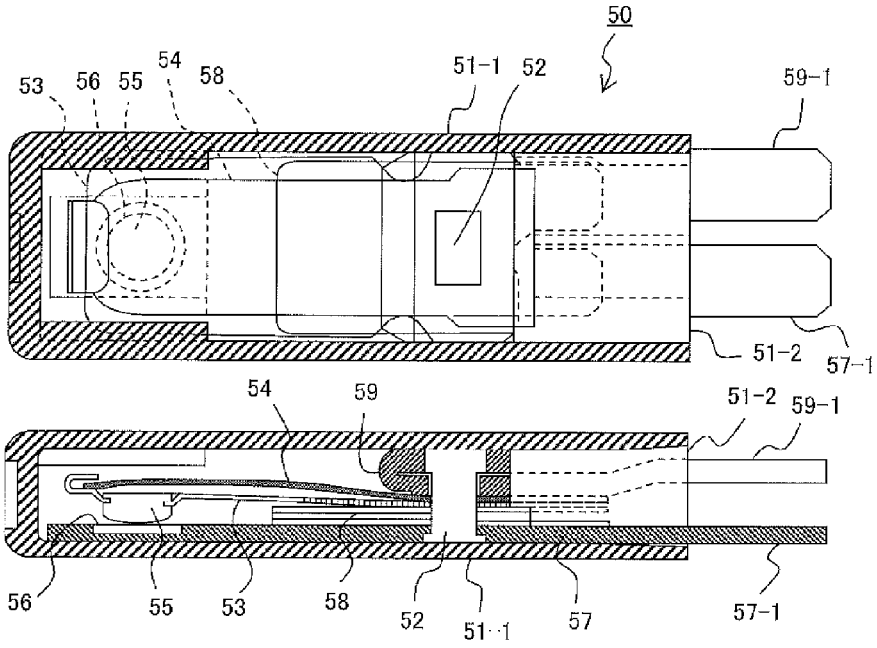
PRIOR ART F I G. 6
FIG. 6 is a perspective top view and a side sectional view of a structure of a self-hold type thermal protector adopting a conventional ceramic PTC element.

FIG. 4A is an exploded perspective view of an internal configuration of a thermal protector according to the third embodiment, whereas FIG. 4B is a side sectional view of the assembled thermal protector. FIG. 4B is a sectional view of the thermal protector sectioned at the support column 112 of FIG. 4A in the horizontal direction (from an obliquely lower left section toward an obliquely upper right section in FIG. 4A).

As illustrated in FIG. 4A, the internal configuration of the thermal protector according to this embodiment is composed of a movable contact side terminal 106, a bimetal 107, a movable plate 108, a spacer 109, a resistive element module 110, a fixed contact side terminal 111, and a support column 112.

As illustrated in FIGS. 4A and 4B, an installation part of the movable contact side terminal 106 in a rear portion (an obliquely upper left direction in FIG. 4A) is composed of a lower layer part 113 and an upper layer part 114. A slightly smaller hole 115 is formed in the lower layer part 113, whereas a slightly larger hole 116 is formed at a position that overlaps with the hole 115 in the upper layer part 114.

The bimetal 107 is normally in an upwardly convex state, and a terminal connection part 117 that protrudes forward from a side is formed at the front end part (an obliquely lower right direction in FIG. 4A). Moreover, a hole 118 of almost the same size as the hole 115 of the lower layer part 113 of the movable contact side terminal 106 is formed at the front end part.

On the movable plate 108, a terminal connection part 119 that protrudes forward from the side of the front end part is formed similar to the bimetal 107. Also at this front end part, a hole 121 of almost the same size as the hole 115 of the lower layer part 113 of the movable contact side terminal 106 is formed. Moreover, a movable contact 122 that extrudes downward is formed in the vicinity of the end part at the rear end part, and a hook part 123 folded forward is formed at the endmost part.

The spacer 109 is formed in the shape of a rectangular frame. The size of a hole 124 formed by an inner perimeter of the frame is almost the same as the hole 115 of the lower layer part 113 of the movable contact side terminal 106.

The resistive element module 110 is composed of an internal resistor 125, a movable contact side connection terminal 126, and a fixed contact side connection terminal 127. The rear parts of the movable contact side connection terminal 126 and the fixed contact side connection terminal 127 are respectively connected and fixed to the entirety of the surfaces of thin-layer electrode films that are not illustrated and are respectively formed on both the upper and the lower surfaces of the internal resistor 125.

Additionally, in the resistive element module 110, a hole 128 that penetrates into the internal resistor 125, the movable contact side connection terminal 126, and the fixed contact side connection terminal 127 is formed. The size of the hole 128 is formed to be almost the same as an outer perimeter of the rectangular frame of the spacer 109.

The fixed contact side terminal 111 is composed of a support part 129 adjoined to the rear of the terminal part, and a contact part 131 further adjoined to the rear of the support part 129. At the end of the contact part 131, a fixed contact is provided at a position facing the movable contact 122, although this is not particularly illustrated.

Additionally, a level-difference hole 132 is formed in the vicinity of the end part of the support part 129 in which the fixed contact side terminal 111 is positioned. Within the level-difference hole 132, level differences are formed in a decreasing order from the bottom toward the top of an inner perimeter. The bottom of the support column 112 engages with the level-difference hole 132.

At an outer perimeter at the bottom of the support column 112, a flange part 112-1 that engages with the larger level difference at the bottom of the hole 132 is formed, and the upper part of the support column 112 is formed to be almost the same size as the hole 115 of the lower layer part 113 of the movable contact side terminal 106.

As illustrated with a dotted dashed line 133 of FIG. 4A, the respective members are inserted in the support column 112 through their holes 128, 124, 121, 118, and 115 (and 116) in this order so that the upper portion of the support column 112 exactly fits into the holes without any extra space. At this time, the holes are engaged with the support column 112 while the rear part of the bimetal 107 is inserted into the void of the hook 123 of the movable plate 108.

As a result, the movable contact side terminal 106, the bimetal 107, the movable plate 108, the spacer 109, the resistive element module 110, and the fixed contact side terminal 111 overlap so as to integrate into one piece as illustrated in FIG. 4B. Consequently, the internal configuration aligned and fixed by the support column 112 is completed.

Thermal protector 135 according to this embodiment is completed by accommodating the internal configuration within the housing 134 of the thermal protector 135 as illustrated in FIG. 4B.

The outer appearance and the internal arrangement of the completed thermal protector 135 are almost the same as those of the thermal protector 100 illustrated in FIGS. 3B and 3C except that the functions and the shape of the support column and electric connection forms are different.

Accordingly, also in this embodiment, when the internal resistor 125 composed of a polymer PTC element produces heat, the total heat can be efficiently conducted to the bimetal 107.

In the internal configuration of the thermal protector 135 according to this embodiment, the respective members overlap with allowances in the thickness direction. Electrical connections of the members are made to the movable contact side terminal 106, for example, by soldering or welding the terminal connection part 117, the terminal connection part 119, and the movable contact side connection terminal 126, and electrical connections of the members are made to the fixed contact side terminal 111, for example, by soldering or welding the fixed contact side connection terminal 127.

Accordingly, even if the allowances are provided in the thickness direction of the overlapping members, there are no problems in the electrical connections. Moreover, the height of the spacer 109 is formed to be higher than the thickness (height) of the resistive element module 110.

A difference between the heights is almost equal to the total of the allowances in the thickness direction of the overlapping members, and this difference is a difference that can absorb an increase in the thickness if the thickness is increased by a volume expansion caused by a thermal expansion when the internal resistor 125 of the resistive element module 110 produces heat.

Operations of the thermal protector 135 having the above described configuration according to the third embodiment are described next. Initially, when an environmental temperature (ambient temperature) of the thermal protector 135 rises to a predetermined temperature or higher, the bimetal 107 inversely warps from the upwardly convex state illustrated in FIG. 4A to the upwardly concave state.

The free end that holds the movable contact 122 of the movable plate 108 rises with the inverse warp operation of the bimetal 107. As a result, the movable contact 122 is separated from the fixed contact that is not illustrated and provided in the contact part 131 of the fixed contact side terminal 111, and a current circuit between the movable contact side terminal 106 and the fixed contact side terminal 111 is disrupted.

The total amount of an electric current between the fixed contact side terminal 111 and the movable contact side terminal 106 when the contact circuit is disrupted flows into the internal resistor 125 composed of the polymer PTC element of the resistive element module 110, and the internal resistor 125 is made to produce heat. The heat produced by the internal resistor 125 is efficiently conducted to the bimetal 107 as described above.

A temperature of the heat conducted to the bimetal 107 is a predetermined temperature or higher for the bimetal 107. Therefore, the bimetal 107 is not restored to the normal state until an electric current between the fixed contact side terminal 111 and the movable contact side terminal 106 is forcibly disrupted from outside. As a result, the current disrupt state of the contact circuit is maintained.

As described above, also in this embodiment, the thermal protector 135 that performs self-holding with heat produced by the embedded resistive element after an electric current is disrupted is realized.

Additionally, in this embodiment, as described above, the height of the spacer 109 is formed to be higher than the thickness (height) of the resistive element module 110, and a difference between the heights is a difference that can absorb an increase in the thickness if the thickness is increased by a volume expansion caused by a thermal expansion when the internal resistor 125 of the resistive element module 110 produces heat.

Accordingly, the degree of freedom of the volume expansion caused by the thermal expansion of the internal resistor 125 composed of the polymer PTC element is not hindered by an external pressure. Moreover, the movable contact side connection terminal 126 and the fixed contact side connection terminal 127, pasted onto the internal resistor 125, are connected, over wide areas, to the thin-layer electrodes that are not illustrated and provided on the upper and the lower surfaces of the internal resistor 125. Therefore, there is no possibility that the internal resistor 125 composed of the polymer PTC element will cause a hot spot.

As described above, also in the thermal protector 135 according to this embodiment, the stable current disrupt function and the self-hold function after an electric current is disrupted can be implemented even though the polymer PTC element having an unstable element is used as a resistive element for the current disrupt function at the time of heat production.

The invention claimed is:

1. A thermal protector performing self-holding with heat produced by an embedded resistive element after an electric current is disrupted when an ambient temperature rises to a predetermined temperature or higher, comprising:

a main body housing;

a bimetallic element inversely warping at a predetermined temperature;

a conductive movable plate having a movable contact;

a conductive fixture plate having a fixed contact;

a resistive element having electrodes on both surfaces of an internal resistor; and first and second terminal members respectively pasted onto the electrodes on both the surfaces of the resistive element, wherein the main body housing, configured with a case having an opening on one surface and an insulative filling material for sealing the opening, includes the bimetallic element, the movable plate, a major portion of the fixture plate, the resistive element, and the first and the second terminal members, facing end parts of the bimetallic element respectively engage with corresponding end parts of the movable plate, the movable plate has a fixed end part connected to one of two external circuits and has a movable end part having the movable contact on a side opposite to the fixed end part, the movable end part being driven to move the movable contact from a closed side to an open side with an inverse warp operation of the bimetallic element at the predetermined temperature, the fixture plate has a fixed contact at a position facing the movable contact and a connection part connected to the other of the external circuits, the resistive element is formed in a shape of a plate, and a hole that penetrates into the internal resistor and the electrodes on both the surfaces is provided in a thickness direction of the plate, a hole that is smaller than the hole that penetrates into the internal resistor and the electrodes is formed in the first terminal member in a portion that overlaps with the hole that penetrates into the internal resistor and the electrode, the first terminal member being connected and fixed to the fixed end part of the movable plate by swaging a periphery of the hole that is smaller than the hole that penetrates into the internal resistor and the electrodes with a member that forms a swage part within the hole that penetrates into the internal resistor and the electrodes, and a hole that is at least equal to or larger than the hole that penetrates into the internal resistor and the electrode is formed in the second terminal member in a portion that overlaps with the hole that penetrates into the internal resistor and the electrode, the second terminal member having a bowing part in a protruding portion, and a gap that is formed between an upper inner wall of the main body housing and the upper surface of the second terminal member, which is connected to the fixture plate via a bent corner adjoined to the bowing part, where the bowing part can fluctuate within the range of a thickness that has been increased by a thermal expansion of the internal resistor of the resistive element.

2. The thermal protector according to claim 1, further comprising an insulative member that is provided at a position further inward than the insulative filling material and further outward than the resistive element, and that prevents the insulative filling material from intruding deeper into the main body housing.

3. The thermal protector according to claim 1, wherein the resistive element is a polymer PTC (Positive Temperature Coefficient) element.

4. The thermal protector according to claim 2, wherein the resistive element is a polymer PTC (Positive Temperature Coefficient) element.

* * * * *